United States Patent [19]

Guadagnin et al.

[11] 4,177,646

[45] Dec. 11, 1979

[54] LIQUEFIED GAS APPARATUS

[75] Inventors: Laurent J. Guadagnin; Claude R. Grossiord; John A. Jensen, all of Annecy, France; Antoine Kawam, Washington, D.C.; Jacques M. Mouchet, Annecy-le-Vieux; Michel E. Royer, la Balme de Sillingy, both of France

[73] Assignee: S. T. Dupont, Paris, France

[21] Appl. No.: 852,415

[22] Filed: Nov. 17, 1977 (Under 37 CFR 1.47)

[30] Foreign Application Priority Data

Nov. 19, 1976 [FR] France ..... 76 35039

[51] Int. Cl.[2] ..... F17C 7/00

[52] U.S. Cl. ..... 62/52; 431/130; 431/344

[58] Field of Search ..... 431/130, 131, 150, 344, 431/276, 277; 62/52

[56] References Cited

U.S. PATENT DOCUMENTS

| | | | |
|---|---|---|---|
| 2,892,251 | 6/1959 | Felt | 431/131 |
| 3,148,522 | 9/1964 | Court | 431/131 |
| 3,407,615 | 10/1968 | Klipping | 62/52 |
| 3,471,246 | 10/1969 | Piffath et al. | 431/150 |
| 3,589,851 | 6/1971 | Rabe | 431/131 |
| 3,597,140 | 8/1971 | Rabe | 431/131 |
| 3,709,462 | 1/1973 | Piffath | 431/344 |
| 4,008,992 | 2/1977 | Johnsson | 431/344 |

*Primary Examiner*—John J. Camby

*Attorney, Agent, or Firm*—Richard A. Wise; Mandel E. Slater

[57] ABSTRACT

A liquefied gas apparatus, in particular a gas lighter for smokers, is disclosed, utilizing a vaporizer-pressure reducer assembly including a pressure reducing device situated generally within a vaporizer. All solid materials with which the assembly is in contact have a thermal conductivity in the range 0.3 to 5 kcal/m/h/° C.

14 Claims, 9 Drawing Figures

LIQUEFIED GAS APPARATUS

BACKGROUND OF THE INVENTION

1. Field of the Invention

This invention relates to liquefied gas apparatus, and is directed more particularly to gas lighters for smokers.

2. Description of the Prior Art

Proper operation of liquefied gas apparatus requires a vaporizer, i.e. a device ensuring that the gas stored in the liquid state changes to the gaseous state and which, among other functions, must therefore conduct to the liquefied gas the heat necessary for it to pass into the gaseous state. In addition in such apparatus a pressure reducing device ensuring control of the flow of discharged gas must also be provided. This flow control can occur before, during, or after the transition to the gaseous state.

Generally these two devices are combined into one, as a result of which some of the heat supplied to the vaporizer is transmitted also to the flow-control device, impeding its operation, sometimes even to the point of occluding it (like a "vapor lock"). Of course, if insufficient heat is supplied, liquid state material may appear on the downstream side of the apparatus.

In order to overcome this disadvantage, it has been proposed that the flow-control device and the vaporizer be thermally insulated from each other. However, since absolute thermal isolation is impossible to achieve, this arrangement is not effective when the heat flows exceed certain levels.

SUMMARY OF THE INVENTION

Accordingly the principal object of the present invention is to provide an arrangement in which the heat necessary for vaporization may have practically no effect on the operation of the flow-control device.

With the above and other objects in view a feature of the present invention is the provision of liquefied gas apparatus, in particular a gas lighter for smokers, including a vaporizer-pressure reducer, i.e. a device ensuring both transition to the gaseous state of the gas stored in the liquid state and flow control of the discharged gas, the gas unit being characterized in that all the solid materials with which the vaporizer-pressure reducer is in contact have a thermal conductivity of less than 5 and preferably greater than 0.3 kilocalories per meter per hour per degree Centigrade (kcal/m/h/°C.). Examples of suitable materials are plastics such as nylon 6—6, "Delrin," and polyvinyl chloride.

In a preferred embodiment of the invention, the vaporizer-pressure reducer comprises a metal mass of thermal conductivity greater than 40 kcal/m/h/°C. In the case of a plastic lighter this mass will, for example, be disposed in a recess provided for this purpose in the body of the lighter.

According to another particularly advantageous embodiment of the invention the vaporizer-pressure reducer consists of a metal jacket inside which is held a sintered metal part. In other preferred embodiments the metal jacket is substantially longer than the sintered part it surrounds. The sintered metal part may also be replaced by a porous wick.

The above and other features of the invention, including various novel details of construction and combinations of parts, will now be more particularly described with reference to the accompanying drawing and pointed out in the claims. It will be understood that the particular devices embodying the invention are shown by illustration only and not as a limitation of the invention. The principles and features of this invention may be employed in various and numerous embodiments without departing from the scope of the invention.

BRIEF DESCRIPTION OF THE DRAWING

Reference is made to the accompanying drawing in which are shown illustrative embodiments of the invention from which its novel features and advantages will be apparent.

DESCRIPTION OF THE PREFERRED EMBODIMENTS

Figure 1:
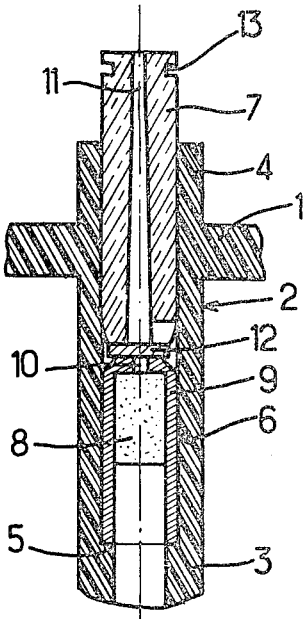
FIG. 1 is a partial cross sectional view of one embodiment of the invention applied to a non-adjustable lighter.

Referring to the drawing, in FIG. 1 a molded plastic lighter has a body portion 1 and tube 2 molded integrally with body 1. Lower portion 3 of this tube has an end (not shown) which opens into a liquefied gas storage reservoir, and which also has a smaller diameter than the upper portion 4, which opens out inside the lighter, thus forming an internal shoulder indicated at 5.

In upper portion 4 of tube 2 a vaporizer-pressure reducer 6 and a burner 7 are disposed in succession. The vaporizer-pressure reducer, which rests on internal shoulder 5, includes a sintered metal cylinder 8 force fitted within a metal tube 9, which is closed on the burner side except for an orifice 10, of capillary dimension. It is to be noted that the length of tube 9 is considerably greater than that of cylinder 8.

Burner 7 has an axial channel 11 with a lateral outlet in its lower portion, a seal 12, and a groove 13 for the connection of external spring means (not shown) to raise and lower the burner. Seal 12 is made of elastomeric material, for example butadiene-acrylonitrile rubber.

In operation the vaporizer-pressure reducer is supplied with liquefied gas from the gas storage reservoir through lower portion 3 of tube 2. When the burner is raised, seal 12 unseats from orifice 10, and the pressure prevailing in the storage reservoir, which is higher than atmospheric pressure, forces the liquefied gas through lower portion 3 of tube 2 to the vaporizer-pressure reducer. As it passes through the capillary passages of cylinder 8, the liquefied gas changes to the gaseous state, and the pressure losses it sustains reduce its flow to an acceptable value.

During this vaporization the required heat is obtained first from cylinder 8, then from the portion of metal tube 9 which is in contact with cylinder 8, and finally from the free portion of tube 9. Thus, the heat content available in the vaporizer-pressure reducer is used progressively.

Since the vaporizer-pressure reducer is in contact exclusively with poor conductors, in this case the plastic lighter body and the insulating material comprising seal 12, it is protected against unwanted heat inputs, in particular against the heat available from the burner flame itself. It is to be appreciated of course, that the mass of the metal components must be chosen as a function of the desired flame or gas flow rate required through the device.

Figure 2:
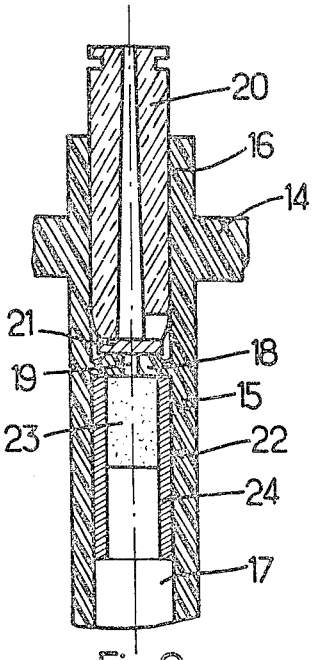
FIG. 2 shows a variant of FIG. 1.

The device shown in FIG. 2 is a variant of FIG. 1. Lighter body 14, made of plastic as in the case of FIG. 1, includes a tube 15 molded in one piece with the body. Inside this tube are two recesses 16 and 17 separated by a crosswise partition 18 provided with a central orifice 19. A burner 20, identical to burner 7 to FIG. 1, is disposed in recess 16, and its seal 21 normally rests on orifice 19. Vaporizer-pressure reducer 22 is disposed in recess 17 and rests against crosswise partition 18. It is composed of a cylinder 23 of sintered metal disposed inside a metal tube 24 open at both ends. As in the case of FIG. 1, tube 24 is considerably longer than cylinder 23. The operation is the same as previously described for the apparatus of FIG. 1.

Figure 3:
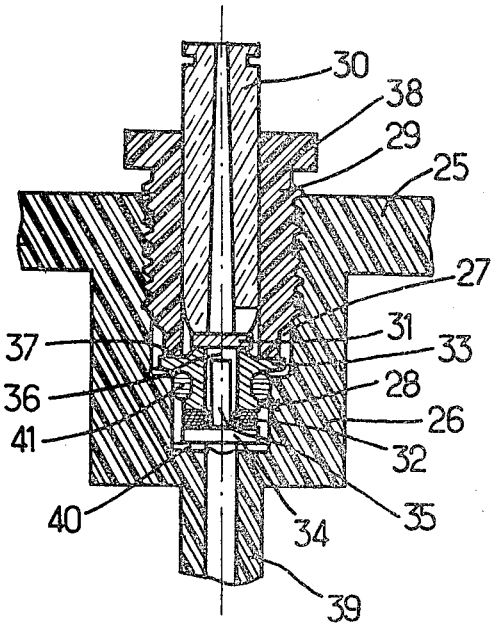
FIG. 3 shows the invention applied to an adjustable lighter.

FIG. 3 shows an embodiment in which the vaporizer-pressure reducer is incorporated within an adjustable lighter.

Body 25 of the lighter is made from plastic material and includes an inner boss 26 extended by tubular portion 39 emerging inside a liquefied gas storage enclosure. Inside the boss, a bore 27, threaded for part of its height, successively receives a vaporizer-pressure reducer, an adjusting screw 29, and a burner 30 and seal 31, the burner being substantially identical to burners 7 and 20 of FIGS. 1 and 2.

The vaporizer-pressure reducer includes a flow control pad 32 made from compressible porous material and a metal mass in two parts, one 33 shaped like an asymmetrical hourglass and the other 34 in the shape of a disc with vertical extension 35. The disc 34 rests on the bottom of the bore which in turn is provided with four radial grooves 40. Vertical extension 35 engages a central opening 36 of element 33. An O-ring 41 made of rubber acts as seal between the wall of the bore and element 33.

The adjusting screw 29 is made from plastic material, like the body of the lighter, and is hollow so as to receive burner 30. It is threaded at its periphery to engage the threaded portion of bore 27. Adjusting screw 29 terminates in a bearing surface 37 in contact with the upper bearing surface of element 33, and it is also provided with a milled ring 38.

In operation, when the burner is lifted, seal 31 releases opening 36, and the liquefied gas arrives through tube 39 and grooves 40 to flow control pad 32, passes through the porous flow control pad and into the annular channel defined by extension 35 of disc 34 and the opening 36 of the asymmetrical element 33; it is then in the gaseous state and can be ignited at the outlet of the burner.

Because the vaporizer-pressure reducer is exclusively in contact with poor heat-conducting materials, it is therefore protected against unwanted heat inputs and especially against heat supplied by the flame at the burner outlet.

The adjustment of the flame is carried out in a conventional way by rotating screw 29 by means of the milled ring 38; this rotation causes a more or less high compression of flow control pad 32 and so modifies the overall section of the capillary passages. As is provided on most smokers' lighters, the angular freedom of milled ring 38 is limited by means not illustrated in the drawing, forming no part of the invention.

Figure 4:
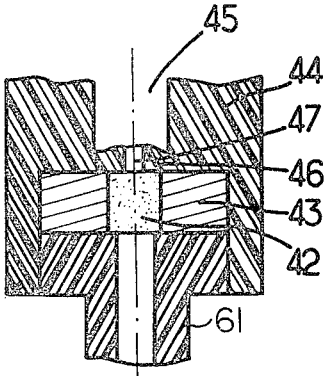
FIGS. 4 to 9 represent six variants of the vaporizer-pressure reducer.

FIG. 4 illustrates a further embodiment in which the vaporizer-pressure reducer is composed of a cylinder 42 made of sintered ceramic or sintered plastic, held in a flat metal cylinder 43. This assembly is retained between feed tube 61 and the portion of the lighter body 44 adapted to receive a burner (not shown) in well 45. The bottom 46 of this well has an orifice 47 normally closed by a burner seal (not shown).

Figure 5:
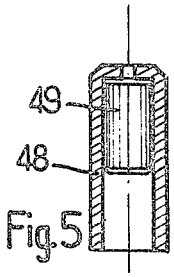

In FIG. 5 the vaporizer-pressure reducer is composed of a cylinder 49 made of plastic, grooved at its periphery to form a plurality of capillary passages with metal tube 48 in which it is positioned. In this embodiment of the invention metal tube 48 is identical to tube 9 of FIG. 1.

Figure 6:
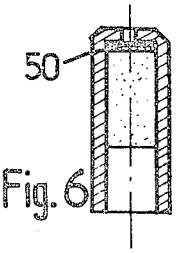

In FIG. 6 the vaporizer-pressure reducer is the same as that of FIG. 1 with the exception of a porous compressible disc 50 disposed between the sintered cylinder and the metal tube.

Figure 7:
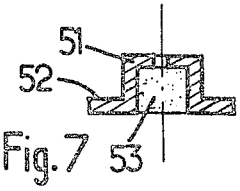

In FIG. 7 the vaporizer-pressure reducer is composed of a bell-shaped member 51 with a circular flange 52. Inside the bell-shaped member is disposed a sintered metal cylinder 53.

Figure 8:
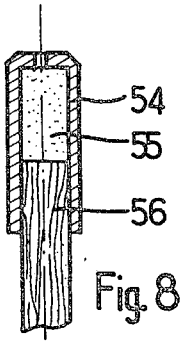

The embodiment of FIG. 8 includes a metal tube 54, identical to tubes 9 and 48 and inside which are disposed sintered metal cylinder 55 and wick 56. The wick is fitted at one end into the free portion of tube 54 and extends at its opposite end into the liquefied gas storage reservoir.

Figure 9:
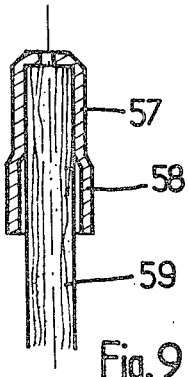

The embodiment of FIG. 9 includes a metal tube 57 whose free portion 58 flares out from the tube such that it does not touch wick 59, which in turn is fitted inside tube 57 and with the tube constitutes the vaporizer-pressure reducer. The purpose of widening portion 58 of tube 57 is to ensure a progressive flow of heat to the end portion of wick 59. The marked simplicity of this arrangement provides a further advantage.

While various aspects of the invention have been illustrated by the foregoing detailed embodiments, it will be understood that various substitutions of equivalents may be made without departing from the spirit and scope of the invention.

What is claimed is:

1. A liquefied gas apparatus comprising a vaporizer-pressure reducer ensuring both transition into the gaseous state of gas stored in the liquid state and control of the flow of the gas discharged therefrom, all solid portins of said apparatus with which said vaporizer-pressure reducer is in contact having a thermal conductivity in the range 0.3 to 5 kcal/m/h/°C.

2. Liquefied gas apparatus as defined in claim 1, in which said vaporizer-pressure reducer comprises a metal mass whose thermal conductivity is greater than 40 kcal/m/h/°C.

3. Liquefied gas apparatus as defined in claim 2, in which said vaporizer-pressure reducer includes a plurality of capillary passages.

4. Liquefied gas apparatus as defined in claim 3, in which said capillary passages are situated at the periphery of a solid mass.

5. Liquefied gas apparatus as defined in claim 3, in which said capillary passages comprise a porous mass.

6. Liquefied gas apparatus as defined in claim 5, in which said porous mass is a sintered component.

7. Liquefied gas apparatus as defined in claim 3, in which at least part of said metal mass is in the form of a tube surrounding said capillary passages.

8. Liquefied gas apparatus as defined in claim 7, in which said metal tube is closed at one end with the exception of an orifice of cross section not exceeding that of a capillary tube.

9. Liquefied gas apparatus as defined in claim 7, in which only part of said metal tube is in contact with said mass forming said capillary passages.

10. Liquefied gas apparatus as defined in claim 1, in which said vaporizer-pressure reducer is disposed in a plastic tube opening out into a liquefied gas storage reservoir.

11. Liquefied gas apparatus as defined in claim 7, in which a porous wick having two ends is held by one end in said metal tube, the second end of said porous wick being disposed in a liquefied gas storage reservoir.

12. Liquefied gas apparatus as defined in claim 11, in which said wick constitutes said capillary passages of said vaporizer-pressure reducer.

13. The invention as defined in claim 1, in which said liquefied gas apparatus is a lighter.

14. Liquefied gas apparatus as defined in claim 3, and further including means for varying the overall section of said capillary passages.

* * * * *